US008959853B2

(12) United States Patent
Bortell

(10) Patent No.: US 8,959,853 B2
(45) Date of Patent: Feb. 24, 2015

(54) MOUNTING SYSTEM FOR A GASKET WHICH PREVENTS WATER AND MOISTURE INFILTRATION OF THE FASCIA REGION OF A ROOF

(71) Applicant: David Bortell, Shirley, MA (US)

(72) Inventor: David Bortell, Shirley, MA (US)

( * ) Notice: Subject to any disclaimer, the term of this patent is extended or adjusted under 35 U.S.C. 154(b) by 0 days.

(21) Appl. No.: 13/958,832

(22) Filed: Aug. 5, 2013

(65) Prior Publication Data

US 2014/0041327 A1 Feb. 13, 2014

Related U.S. Application Data

(60) Provisional application No. 61/680,418, filed on Aug. 7, 2012.

(51) Int. Cl.
*E04D 13/04* (2006.01)

(52) U.S. Cl.
USPC ..... 52/219; 52/58; 52/60; 52/94; 52/97

(58) Field of Classification Search
USPC ..... 52/219, 24–26, 58–60, 94–97
See application file for complete search history.

(56) References Cited

U.S. PATENT DOCUMENTS

| | | | | | |
|---|---|---|---|---|---|
| 2,974,448 | A * | 3/1961 | Weis | 52/60 |
| 4,037,372 | A * | 7/1977 | Patry | 52/96 |
| 4,112,632 | A * | 9/1978 | Simpson | 52/11 |
| 4,190,989 | A * | 3/1980 | Sakharoff | 52/60 |
| 4,759,157 | A * | 7/1988 | Webb et al. | 52/60 |
| 4,780,999 | A * | 11/1988 | Webb et al. | 52/96 |
| 4,970,832 | A * | 11/1990 | van Herpen | 52/60 |
| 5,123,208 | A * | 6/1992 | Kirby et al. | 52/58 |
| 5,953,861 | A * | 9/1999 | Podgwaite | 52/11 |
| 6,108,981 | A * | 8/2000 | Sama et al. | 52/60 |
| 6,167,660 | B1 * | 1/2001 | Sama | 52/58 |

* cited by examiner

*Primary Examiner* — Jeanette E. Chapman
(74) *Attorney, Agent, or Firm* — Robert M. Schwartz

(57) ABSTRACT

A gasket for use on a drip edge flashing and a fascia board on a roof overhang is provided. The gasket is mounted intermediate the fascia of the sidewalls of a structure and the drip edge flashing which overhangs a portion of the perimeter of the roof. The drip edge flashing has a u-shaped element which is adapted to receive a bracket which is attached to the gasket. The gasket may also be affixed to the fascia board by an adhesive. The gasket prevents ice, water and humidity from entering any of the sub-roof structure, which inhibits rot, molds or insect infestation. The gasket may be placed on new structures or retrofit. In the retrofit embodiment, a support flashing with a u-shaped element is interfit between the drip edge flashing and the gasket. In this case the u-shaped element on the support flashing receives the gasket bracket therein.

20 Claims, 2 Drawing Sheets

MOUNTING SYSTEM FOR A GASKET WHICH PREVENTS WATER AND MOISTURE INFILTRATION OF THE FASCIA REGION OF A ROOF

INDEX TO RELATED APPLICATIONS

This application claims the benefit of U.S. Provisional Patent Application Ser. No. 61/680,418 filed on Aug. 7, 2012, entitled Water Wick Backflow Reduction Roof Flashing, the disclosure of which is incorporated herein by reference in its entirety.

BACKGROUND OF THE INVENTION

The present invention is an improvement to the downside edge of roof flashing where water, ice and humidity accumulate in the eave area of a roof. Such water, ice and humidity accumulation is undesirable as it may often cause damage to the fascia board, sheathing and under roof structure, soffits, interior and exterior ceilings and materials to the roof. Such water, ice, or humidity accumulation occurs during rain storms, snow storms, and other events such as a temperature drop below freezing after a rainstorm or a high humidity buildup which may occur on a hot day after a rainstorm. Also, wet regions such as river valleys, swampland, low lying land and the like contribute to high levels of humidity. Water, in any of these forms, (solid, liquid or vapor) have may cause rot or damage to wooden elements of the roof and supporting interior structures. Such conditions may help the growth of damaging molds or form an environment which could encourage insect or other undesirable infestations. Notwithstanding that drip edge flashings are designed to shed water away from the roof edge, it has been found that moisture and water will wick up or backflow into the roof soffit area at the eaves of a roof. The instant invention forms a water/moisture barrier intermediate the flashing and the fascia board, preventing the negative and harmful effects of moisture in the region of the roof soffit and other areas of concern.

BRIEF SUMMARY OF THE INVENTION

The present invention is a gasket which can be affixed intermediate the fascia board of a house and the drip edge flashing forming a water tight seal. The gasket of the present invention can be installed during the installation of new roof drip flashings or it can be installed and added to existing roof drip flashings.

Ordinarily, the drip edge flashing extends past the edge of the roof sheathing in order to protect the roof plywood from water, snow and the like. In addition a typical drip edge flashing will extend vertically below the edge of the roof to protect at least a portion of the fascia board and exposed portions of sheathing from the elements.

The gasket of the present invention may be oval, circular or of another geometrical configuration. The gasket would be affixed intermediate the fascia board and a drip edge flashing. The gasket forms a seal to the previously exposed portions of the fascia from water wicking, humidity and other environmental intrusions. The gasket is held in place against the fascia board by adhesive or other attachment means. The gasket includes a generally L-shaped bracket which depends from the side of the gasket (the side which is not attached to the fascia board). The drip edge flashing includes a u-shaped portion on its bottom portion. The u-shaped portion of the drip edge flashing is adapted to receive the long side of the L-shaped bracket therein. The drip edge flashing keeps the gasket in place against the fascia board. Fasteners may be employed to aid in the mounting of the gasket.

The gasket may be manufactured from, but is not limited to, neoprene (polychloroprene), silicone, nitrile rubber, rubber, plastic polymers, polychlorotrifluoroethylene, and the like. Any material which is employed to manufacture a gasket which meets the mechanical and material requirements of the invention may be used. Polychlorotrifluoroethylene has the lowest water vapor transmission rate of any plastic.

DETAILED DESCRIPTION OF THE PREFERRED EMBODIMENT

Figure 1:
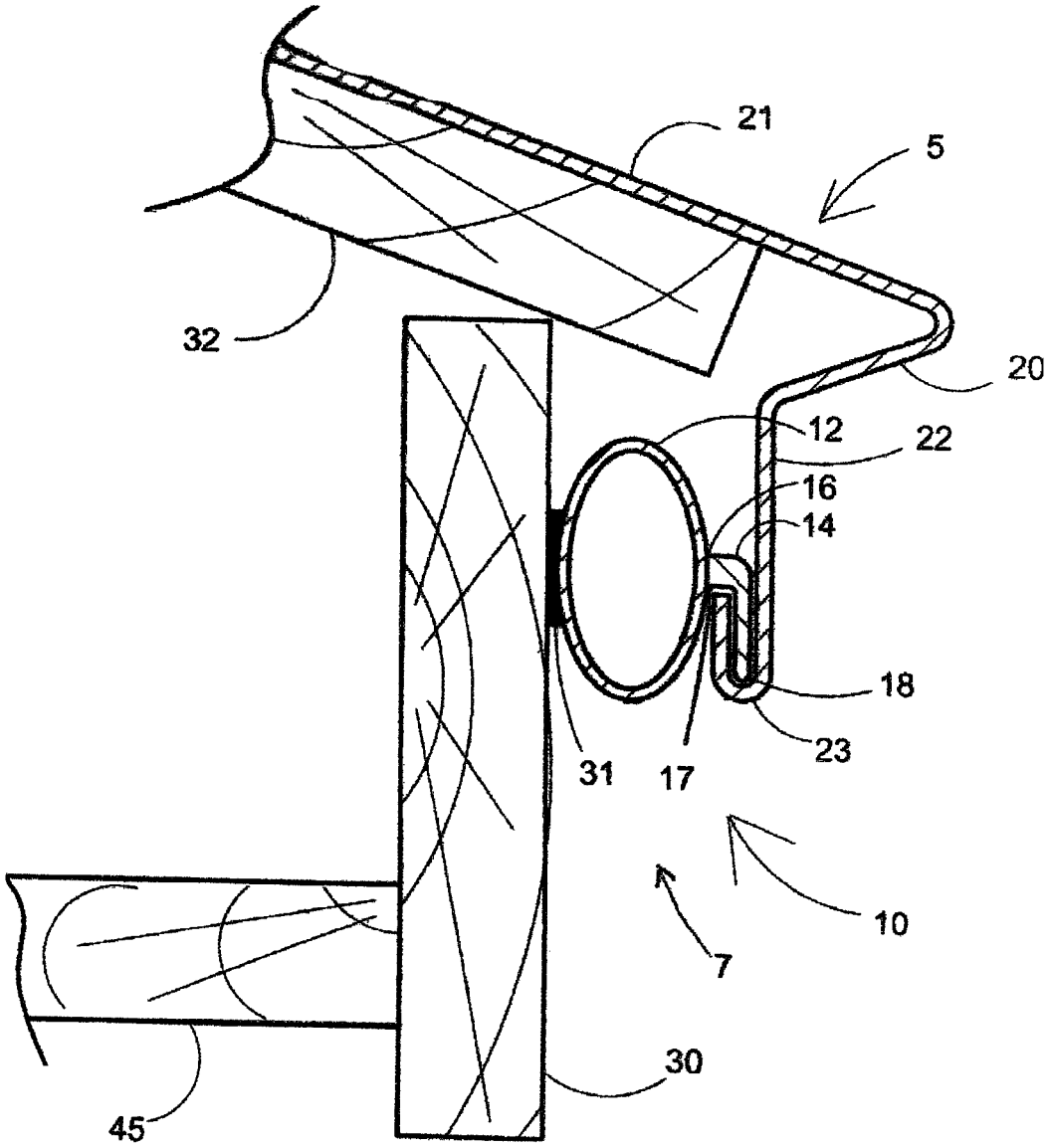
FIG. 1 is a sectional view of a roof overhang showing a new roof flashing, the roof plywood sheathing, the fascia board and the gasket intermediate the fascia board and the flashing to form a water-proof seal.

Referring to FIG. 1 is shown in section a portion of roof 5, in the area of the eaves and fascia 7 and soffit 45. Also shown is a drip edge flashing 20 having an over roof sheathing portion 21 and a vertical portion 22. The vertical portion includes a u-shaped portion 23 that is pressed and crimped to hold gasket portion end 18. The flashings shown in the drawing figures are in section and are elongated and extend along and in the general area of the length of the roof edges. Such flashing may be comprised of aluminum, copper, galvanized steel or the like. The flashing shown in FIG. 1 is one possible configuration, different structures may include any of a host of commercially available flashings which may be modified to include a u-shaped portion 23 which could be adapted to receive the gasket 12 and bracket 14 therein. The gasket 12 is oval and the bracket 14 is attached to the outside wall of the oval gasket 12, proximal to its semi-minor axis, on the side of the oval gasket which is most distant from the fascia board structure.

The present invention, as seen in FIG. 1. is a gasket mounting system 10. The gasket mounting system 10 includes an oval gasket 12 and an attachment bracket 14. In a preferred embodiment gasket 12 is made of neoprene. Further, gasket 12 is flexible and though shown having an oval shape in the preferred embodiment, other geometrical shapes may be employed. Such geometrical shapes may include a circle, an ellipse, a rectangle or a square. More elaborate geometric configurations for the gasket 12 may be employed in special circumstances, either structural or environmental. The gasket bracket 14 is securely connected to gasket 12 at a connection area 16 located on one side of gasket 12. Gasket bracket 14 has an elongated gasket portion end 18 perpendicular to gasket bracket 14. Gasket 12 is securely placed and located between the inner side wall of the drip edge flashing vertical portion 22 and the fascia board structure 30. The gasket 12 thus forms a seal to protect the soffit area 45 under the roof eaves 5 from the outside environment.

Attachment gasket bracket 14 includes a right angle bend, preferably factory formed, having a first gasket end 17 connected to gasket 12 and a second gasket portion end 18 constructed and arranged to fit within u-shaped vertical return portion 23. Gasket portion end 18 may be pressed or crimped within u-shaped vertical return portion 23 or may be held there within by an adhesive (not shown) or attached in other ways known in the art.

Gasket 12 is supported and held in place between vertical portion 22 and fascia board 30. Drip edge flashing 22 will exert sufficient pressure against gasket 12 pushing it against fascia board 30 so that gasket 12 will form a seal of the area inside the fascia area 7 bounded by the drip edge flashing 20, the fascia board 30 and the roof plywood 32. Additionally it may be desirable to enhance the sealed area heretofore described, to use a foam or adhesive 31 to be applied between gasket 12 and fascia board 30. Such foams or adhesives will be chosen for their water-proof or water-resistant properties.

Figure 2:
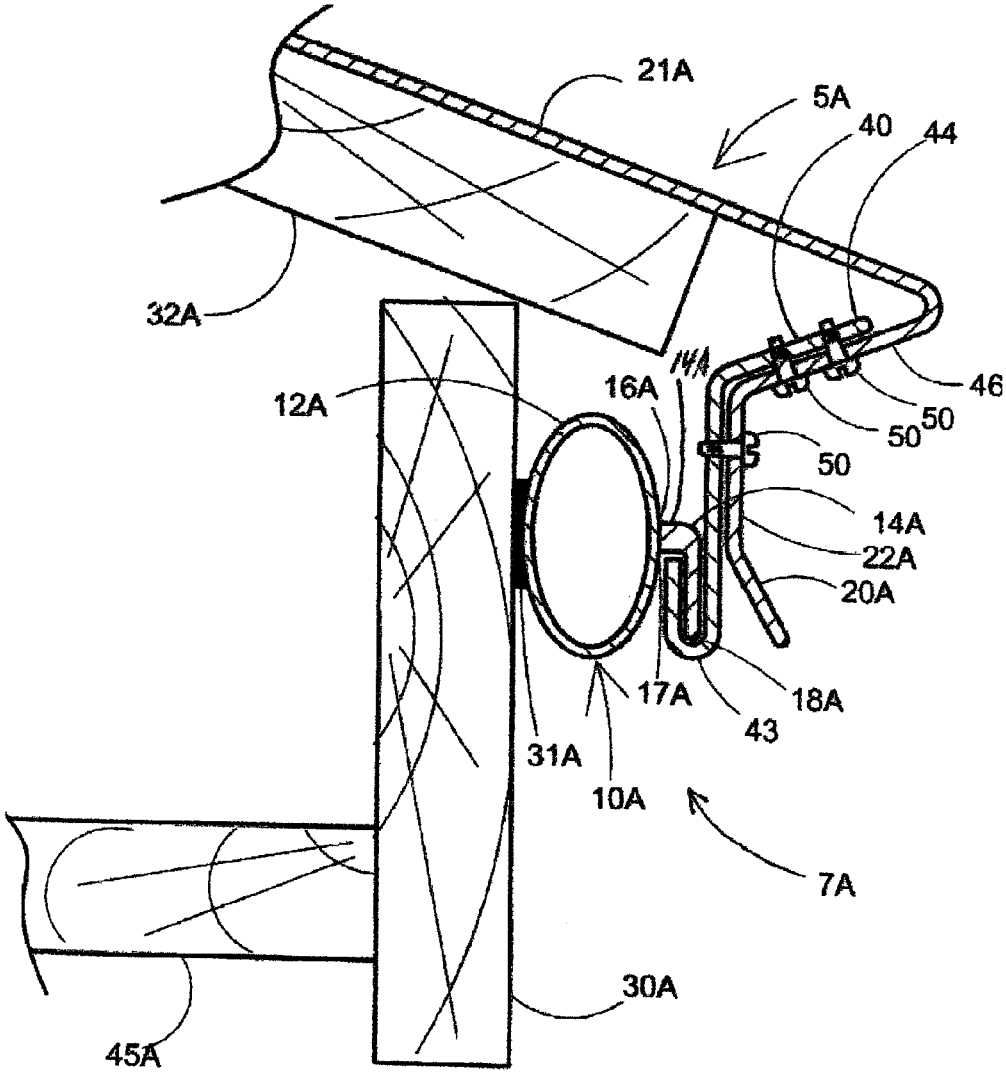
FIG. 2. is a sectional view of a roof overhang showing an existing roof flashing, the roof plywood sheathing, the fascia board and the gasket intermediate the fascia board and the support flashing to form a water-proof seal.

FIG. 2 discloses the placement and mounting of the gasket 12A on an existing roofing system. The gasket 12 is oval and the bracket 14A is attached to the outside wall of the oval gasket 12A, proximal to it's semi-minor axis, on the side of the oval gasket which is most distant from the fascia board structure. —In such a case where gasket mounting system 10A is desired to be used with an existing roofing system, as shown in FIG. 2, a support flashing 40 is used in conjunction with the existing drip edge flashing 20A. FIG. 2 shows in section a portion of roof 5A, in the area of the eaves and fascia 7A and soffit 45A. Also shown is a drip edge flashing 20A having an over roof sheathing portion 21A and a vertical portion 22A. In this embodiment, the support flashing 40 will be inserted intermediate the drip edge flashing 20A and the gasket 12A. The support flashing 40 includes an upper portion 44 which is angled to be placed in the interior of the portion of the drip edge flashing 20A indicated generally at point 46. The support flashing 40 will be constructed to essentially conform to the inside shape of drip edge flashing 20A and will be attached thereto by fasteners 50, including, but not limited to rivets, screws, nails or the like. The use of other attachment means such as adhesive has also been contemplated. At least one fastener 50 will be employed; three are shown in FIG. 2. The number of fasteners may vary due to specific flashing configuration. Three fasteners 50 are shown in FIG. 2. attaching the support flashing 40 to the drip edge flashing 20A. In this embodiment the drip edge flashing 20A does not have an integral u-shaped vertical return portion thereon, an u-shaped portion 43 is incorporated at the bottom of the support flashing 40. Once the support flashing 40 is installed along substantially the entire length of existing drip edge flashing 20A, then the u-shaped portion 43 will be in position to support and receive the gasket portion end 18A of attachment bracket 14A.

When the drip edge flashing 20A and the support flashing 40 are affixed by fasteners 50, the two flashing elements essentially form a single flashing element.

When installed, the drip edge flashing 20A and the support flashing 40 will support the gasket 12A against the fascia board 30A forming a watertight seal.

Other means to secure the gasket (12, 12A) intermediate an outer flashing 20 and the fascia board 30 have also been contemplated. For instance, if a u-shaped vertical return portion similar to 23 was mechanically affixed to the fascia board 30, the gasket 12 with its right angled male mounting element may be reversed and the gasket would be urged toward the fascia board 30 by the drip edge flashing 20. Other methods to hang, affix, interfit or place the gasket 12 intermediate the drip edge flashing 20 and the fascia board 30 in such a fashion to block water, ice or humid air from entering the area proximal the upper fascia board 30 and the lower roof wood elements may be employed. These include, but are not limited to, a u-shaped element affixed to the fascia board 30 as well as the interior of the drip edge flashing where the gasket would include a right and a left gasket bracket, where each gasket bracket would be adapted to be retained in the two u-shaped elements. Also, a hanging device secured to the underside of the roof plywood (or other roof material) could be attached to the twelve o'clock position of the gasket.

It is to be understood that houses and buildings do not all have the same structure at the area of the terminus of the roof and the sidewall of the house. The water-proof (or water-resistant) gasket can be adapted for use in these circumstances and are considered to be part of the invention.

While the invention has been described in its preferred form or embodiment with some degree of particularity, it is understood that this description has been given only by way of example and that numerous changes in the details of construction, fabrication, and use, including the combination and arrangement of parts, may be made without departing from the spirit and scope of the invention.

I claim:

1. A gasket for use in a roof overhang in combination with a gasket support flashing, a drip edge flashing and a fascia board comprising:

a gasket attached to a first end of a bracket, said bracket having a second end for attachment to said gasket support flashing, said gasket support flashing is disposed intermediate said drip edge flashing and said gasket, both said gasket support flashing and said drip edge flashing depend substantially vertical and downward from said fascia of the roof, and a portion of said gasket support flashing proximal to said gasket is parallel to said fascia board, whereby said gasket support flashing supports said gasket against said fascia board, forming a water-proof seal and said gasket support flashing and said drip edge flashing are attached by fasteners.

2. A gasket for use in a roof overhang including a gasket support flashing, a drip edge flashing and a fascia board as claimed in claim 1 wherein said gasket first side is in contact with said fascia board.

3. A gasket for use in a roof overhang including a gasket support flashing, a drip edge flashing and a fascia board as claimed in claim 1 wherein said gasket first side is affixed to said fascia board by an adhesive.

4. A gasket for use in a roof overhang including a gasket support flashing, a drip edge flashing and a fascia board as claimed in claim 1 whereby said gasket is comprised of a material selected from the group consisting of polychloroprene (neoprene), silicone, nitrile rubber, rubber, plastic polymers, and polychlorotrifluoroethylene.

5. A waterproof seal about a roof overhang and a fascia of a structure including a combination of a gasket, a gasket support flashing, and a drip edge flashing comprising:

a gasket having a first side and a second side, said first side including a male adapter, said gasket support flashing having a female adapter, said male adapter connects to said female adapter forming a watertight seal, said gasket support flashing is further disposed intermediate said drip edge flashing and said gasket, both said gasket support flashing and said drip edge flashing depends substantially vertical and downward from an over-roof flashing on the roof, and a portion of said gasket support flashing proximal to said gasket is parallel to said fascia board, said gasket support flashing and said drip edge flashing are attached by fasteners, whereby said gasket support flashing supports said gasket against said fascia board, forming a water-proof seal.

6. A waterproof seal about a roof and a fascia of a structure including a combination of a gasket, a gasket support flashing, and a drip edge flashing as claimed in claim 5 wherein said gasket second side is attached to said fascia by adhesive.

7. A gasket for use in combination with a drip edge flashing overhanging a portion of a roof and a fascia board depending from the roof comprising:

a gasket having a first side for attachment to a fascia board, said gasket having a second side for attachment to a drip edge flashing, said drip edge flashing having a portion generally parallel to said fascia board and having an upward oriented u-shaped element, said upward oriented u-shaped element adapted to attach to said second side of said gasket, wherein a water proof sealed area is formed within the overhang portion of said roof, said drip edge flashing and said gasket.

8. A gasket as set forth in claim 7 wherein said gasket has an oval cross-section.

9. A gasket as set forth in claim 7 whereby said over-roof sheathing extends past the roof, is angularly bent back toward said fascia and traverses back towards said fascia, to a point where it is bent vertically downward, and transverses a distance proximal said gasket said downward oriented connection element, where after the point where said over-roof sheathing is bent vertically downward, said drip edge flashing begins.

10. A gasket for use in combination with a drip edge flashing overhanging a portion of a roof and a fascia board depending from the roof as claimed in claim 8 wherein said gasket first side is attached to said fascia board by an adhesive selected from the group consisting of water proof adhesives, water resistant adhesives and adhesive foam, and said gasket said connection element is downwardly oriented.

11. A gasket as set forth in claim 7 whereby said gasket is comprised of a material selected from the group consisting of polychloroprene (neoprene), silicone, nitrile rubber, rubber, plastic polymers, and polychlorotrifluoroethylene.

12. A gasket, and a gasket support flashing for use in an existing roof overhang in combination with an over-roof sheathing, and a drip edge flashing, comprising:

a fascia, said over-roof sheathing extends past the roof, is angularly bent back toward said fascia and traverses back towards said fascia, to a point where it is bent vertically downward, becoming said drip edge flashing, a gasket, said gasket having a first side and a second side, said gasket said first side is attached to said fascia board, said gasket second side includes a first connection element, a support flashing having an upper portion and a lower portion, said upper portion has the same configuration as said over-roof sheathing and said drip edge flashing, said lower portion includes a second connection element, said support flashing is secured inside the over-roof sheathing and the drip edge flashing, said support flashing is secured by mechanical fasteners, said second connection element of said support flashing is affixed with said first connection element on said gasket said second side, forming a water-proof seal about the existing roof overhang.

13. A gasket, and a gasket support flashing for use in an existing roof overhang in combination with an over-roof sheathing, and a drip edge flashing as claimed in claim 12, wherein said gasket is oval.

14. A gasket, and a gasket support flashing for use in an existing roof overhang in combination with an over-roof sheathing, and a drip edge flashing as claimed in claim 13, wherein said gasket first side is attached to said fascia board by an adhesive selected from the group consisting of water proof adhesives, water resistant adhesives and adhesive foam.

15. A gasket, and a gasket support flashing for use in an existing roof overhang in combination with an over-roof sheathing, and a drip edge flashing as claimed in claim 14, whereby said gasket is comprised of a material selected from the group consisting of polychloroprene (neoprene), silicone, nitrile rubber, rubber, plastic polymers, and polychlorotrifluoroethylene.

16. A gasket for use in combination with a flashing overhanging a portion of a roof and a fascia board depending from the roof comprising:

a gasket having a first side for attachment to a fascia board, said gasket having a second side having a first connection element for attachment to a flashing, said gasket being a material selected from the group consisting of polychloroprene (neoprene), silicone, nitrile rubber, rubber and polychlorotrifluoroethylene, said flashing having a portion generally parallel to said fascia board and having an upper portion and a lower portion, said lower portion including a second connection element adapted to attach to said first connection element, wherein a water proof sealed area is formed within the overhang portion of said roof, said flashing and said gasket.

17. A gasket for use in combination with a flashing overhanging a portion of a roof and a fascia board depending from the roof as claimed in claim 16 wherein said flashing is a drip edge flashing.

18. A gasket for use in combination with a flashing overhanging a portion of a roof and a fascia board depending from the roof as claimed in claim 16 including a drip edge flashing, said flashing attached to said drip edge flashing by mechanical fasteners.

19. A gasket for use in combination with a flashing overhanging a portion of a roof and a fascia board depending from the roof as claimed in claim 16 wherein the cross-section of the gasket is oval.

20. A gasket for use in combination with a flashing overhanging a portion of a roof and a fascia board depending from the roof as claimed in claim 16, whereby said gasket said first side is attached to said fascia board by a material comprised of an adhesive selected from the group consisting of polychloroprene (neoprene), silicone, nitrile rubber, rubber, binary adhesive compositions, plastic polymers, and polychlorotrifluoroethylene.

* * * * *